US012601477B2

(12) United States Patent
Bertelli

(10) Patent No.: US 12,601,477 B2
(45) Date of Patent: Apr. 14, 2026

(54) DEVICE AND METHOD FOR CONTROLLING A FUEL-OXIDIZER MIXTURE FOR A PREMIX GAS BURNER

(71) Applicant: BERTELLI & PARTNERS S.R.L., Angiari (IT)

(72) Inventor: Pierluigi Bertelli, Bardolino (IT)

(73) Assignee: BERTELLI & PARTNERS S.R.L., Angiari (IT)

( * ) Notice: Subject to any disclaimer, the term of this patent is extended or adjusted under 35 U.S.C. 154(b) by 401 days.

(21) Appl. No.: 18/178,784

(22) Filed: Mar. 6, 2023

(65) Prior Publication Data

US 2023/0288060 A1 Sep. 14, 2023

(30) Foreign Application Priority Data

Mar. 8, 2022 (IT) ..... 102022000004409

(51) Int. Cl.
*F23D 14/02* (2006.01)
*F23D 14/60* (2006.01)
(Continued)

(52) U.S. Cl.
CPC ..... *F23D 14/60* (2013.01); *F23D 14/02* (2013.01); *F23D 14/62* (2013.01); *F23N 1/025* (2013.01);
(Continued)

(58) Field of Classification Search
CPC ..... F23D 14/60; F23D 14/02; F23D 14/62; F23D 2203/007; F23N 1/025;
(Continued)

(56) References Cited

U.S. PATENT DOCUMENTS 9,097,419 B2 8/2015 Zatti et al.
9,134,026 B2 9/2015 Blaauwwiekel et al.
(Continued)

FOREIGN PATENT DOCUMENTS

CN 109442405 A 3/2019
EP 3508788 A1 7/2019
(Continued)

OTHER PUBLICATIONS

Italian Search Report issued in Italian Application No. 202200004409, dated Oct. 26, 2023.
(Continued)

*Primary Examiner* — Avinash A Savani
(74) *Attorney, Agent, or Firm* — United IP Counselors, LLC

(57) ABSTRACT

A device for controlling a fuel-oxidizer mixture for a premix gas burner includes: an intake duct, including an inlet, a mixing zone, and a delivery outlet; an injection duct; a gas regulating valve, located along the injection duct; a fan, located in the intake duct to generate therein a flow of the oxidizer fluid or of the mixture; a control unit, configured for generating drive signals; a sensor unit, configured to detect a first differential pressure, between a first detecting section, located in the intake duct upstream of the mixing zone in the direction of inflow and a second detecting section, located in the intake duct downstream of the mixing zone in the direction of inflow, and configured to detect a second differential pressure, between the first detecting section and a third detecting section, located in the injection duct between the gas regulating valve and the mixing zone.

18 Claims, 6 Drawing Sheets

(51) Int. Cl.
*F23D 14/62* (2006.01)
*F23N 1/02* (2006.01)
*F23N 5/18* (2006.01)

(52) U.S. Cl.
CPC ..... *F23N 5/184* (2013.01); *F23D 2203/007* (2013.01); *F23N 2005/181* (2013.01); *F23N 2005/185* (2013.01); *F23N 2225/06* (2020.01); *F23N 2235/10* (2020.01); *F23N 2239/04* (2020.01)

(58) Field of Classification Search
CPC .. F23N 5/184; F23N 2225/06; F23N 2235/10; F23N 2239/04; F23N 2005/181; F23N 2005/185
USPC ..... 431/89
See application file for complete search history.

(56) References Cited

U.S. PATENT DOCUMENTS

| | | | | |
|---|---|---|---|---|
| 9,951,951 | B2 | 4/2018 | Lovascio et al. | |
| 10,900,663 | B2 | 1/2021 | Bertelli | |
| 2011/0081619 | A1* | 4/2011 | Praat | F23N 1/002 431/89 |
| 2015/0316254 | A1* | 11/2015 | Kim | F23D 14/62 431/116 |
| 2016/0123584 | A1* | 5/2016 | Young | F23N 1/022 431/89 |
| 2020/0173659 | A1 | 6/2020 | Bertelli | |

FOREIGN PATENT DOCUMENTS

| | | | |
|---|---|---|---|
| FR | 2921461 | A1 | 3/2009 |
| JP | S55131621 | A | 10/1980 |
| JP | 2018151126 | A | 9/2018 |
| RU | 2692854 | C1 | 6/2019 |
| RU | 2715297 | C1 | 2/2020 |

OTHER PUBLICATIONS

Patent Search Report dated Jul. 18, 2023, issued in connection with Eurasion application No. 202390541.

* cited by examiner

DEVICE AND METHOD FOR CONTROLLING A FUEL-OXIDIZER MIXTURE FOR A PREMIX GAS BURNER

CROSS-REFERENCE TO RELATED APPLICATIONS

This application claims priority to, and the benefit of, Italian Patent Application No. 102022000004409 filed on Mar. 8, 2022. The contents of that application are incorporated by reference herein in their entirety.

TECHNICAL FIELD

This invention relates to a device and a method for controlling a fuel-oxidizer mixture for a premix gas burner.

BACKGROUND ART

These control devices are devices which include an intake duct on which a fan is mounted to supply oxidizer. These devices also include a gas regulating valve, mounted on a gas injection duct which leads into the intake duct at a mixing zone, where the oxidizer and the fuel are mixed together. The devices have a control unit for regulating the flow of mixture, fuel and oxidizer. Also known in the prior art are devices for controlling the fuel-oxidizer mixture; these may be pneumatic (where the combustion mixture is regulated without the use of electronic systems) or electronic (where the mixture is regulated and controlled directly by the electronic control circuitry of the appliance).

In the latter case, the electronic circuitry controls the fan and the gas regulating valve to automatically or semi-automatically set the quantity of fuel and oxidizer (for example, with a closed loop control). For this purpose, the device might include process (combustion quality) sensors or feedback sensors on fan and/or gas regulating valve, capable of providing a measure of the regulated quantity of the two individual components. These sensors may be mass flow sensors (traversed by the flow of the fluid to be measured), thermal mass flow sensors designed to measure a pressure difference between one side of a construction and the other (for example, a Venturi flow sensor or a diaphragm sensor or a nozzle flow sensor) on a fuel and/or oxidizer supply duct. Current legislation and safety standards require self-checking sensors, for example, to determine their efficient operation and/or drift over time (in terms of safety with regard to user safety).

It is therefore necessary to provide an additional control quantity in some working stages to allow checking the congruence of the measurement provided by the sensors. These quantities may be, for example, the rpm of a fan in the case of the oxidizer sensor or a correlation with the control curve of the gas regulating valve relating to the fuel. These checks tend to be imprecise and unreliable, depending on the nature of the actuators and operating conditions.

In the case of thermal mass flow sensors, traversed entirely by the flow of the fluid to be measured, or pressure sensors based on a similar principle (which are traversed by a portion of flow in order to measure pressure), the following drawbacks become apparent. Firstly, since the sensors are calibrated for a specific fluid, they vary the feature according to the fluid flowing through them and are therefore inflexible and unsuitable for use with different fluids (unless reset according to the fluid, which is an inconvenient necessity). Moreover, the fluid may contain contaminants present in the gas (for example, biogas) which, in the long run, may damage the sensor or the electronic circuitry, impacting negatively on the reliability of the sensors, and even the safety of the appliance.

Solutions like the ones just described are described, for example, in the following documents: JP2018151126A and JPS55131621A. Other solutions are described, for example, in document FR2921461A1.

BRIEF SUMMARY

This invention has for an aim to provide a device and a method for controlling a fuel-oxidizer mixture to overcome the above mentioned disadvantages of the prior art.

This aim is fully achieved by the device and method of this disclosure as characterized in the appended claims.

According to an aspect of it, this disclosure provides a device for controlling a fuel-oxidizer mixture for a premix gas burner.

The device comprises an intake duct which defines a section through which an oxidizer fluid is admitted into the duct. The intake duct includes an inlet for receiving the oxidizer and a delivery outlet for delivering the mixture to the burner. The intake duct comprises a mixing zone for receiving the fuel and allowing it to be mixed with the oxidizer.

The device comprises an injection duct which defines a section through which the fuel is made to flow. The injection duct is connected to the intake duct in the mixing zone to supply the fuel.

The device comprises a gas regulating valve, located along the injection duct.

The device comprises a fan, located in the intake duct to generate therein a flow of the oxidizer fluid or of the fuel-oxidizer mixture in a direction of inflow. The direction of inflow is oriented from the inlet to the delivery outlet.

The device comprises a control unit. The control unit is configured for generating drive signals, for regulating the gas regulating valve and/or the rotation speed of the intake fan.

The device comprises a sensor unit, in communication with the control unit. The sensor unit is configured to detect two quantities which are correlated with each other, or which are, in any case, representative of a correlation with the quantity of fuel and the quantity of oxidizer. These quantities are used by the control unit (as feedback) for regulating the speed of the fan and/or the opening of the fuel flow regulating valve to obtain a predetermined mixture. The control unit retrieves the parameters defining the predetermined mixture from a memory unit containing the settings representing an ideal (desired) quantity of fuel and/or of oxidizer. The sensor unit is configured to detect a first differential pressure, between a first detecting section (that is to say, a first point or a first zone), located (positioned) in the intake duct upstream of the mixing zone in the direction of inflow and a second detecting section (that is to say, a second point or a second zone), located (positioned) in the intake duct downstream of the mixing zone in the direction of inflow.

It should be borne in mind that according to an aspect of this disclosure, the mixing zone is identified by the presence of a mixing constriction, also known, in the jargon of the trade, as a Venturi, which produces a negative fluid pressure. Thus, the first section is upstream of the Venturi along the intake duct in the direction of inflow, while the second section is downstream of the Venturi along the intake duct in the direction of inflow.

Advantageously, the sensor unit is configured to detect a second differential pressure, between the first detecting section and a third detecting section (that is to say, a third point or a third zone), located in the injection duct between the gas regulating valve and the mixing zone.

With reference to the presence of the Venturi, therefore, the third section is interposed between the Venturi and the gas regulating valve, that is to say, between a zone where the gas and air are already mixed and the gas regulating valve.

Detecting the second differential pressure allows cross checking and thus considerably increases the reliability and flexibility of the control device.

In effect, it allows having two detected values which (both) vary in a manner known to the control unit with the variation in the working parameters. Comparing them therefore allows diagnosing the sensors, which is a fundamental requisite for the safety of these control devices.

It should be noted that the value of the pressure in the first detecting section is greater than the value of the pressure in the second detecting section. The value of the pressure in the first detecting section is also greater than the value of the pressure in the third detecting section.

If the first, second and third detecting sections are located upstream of the fan in the direction of inflow, the pressure in the first detecting section is a preferably atmospheric reference pressure, while the pressure in the second detecting section and that in the third detecting section are negative (relative to the reference pressure). If the first, second and third detecting sections are located downstream of the fan in the direction of inflow, the pressure in the second detecting section and that in the third detecting section are typically greater than atmospheric pressure (that is, they are positive) but in any case lower than the pressure in the first detecting section (which constitutes the reference pressure and is typically positive relative to atmospheric pressure).

The fact that the pressure in the first detecting section is always greater than that in the other two means that under normal operating conditions, the sensor unit (specifically, the sensor that detects the fuel) is never traversed by the fuel but only by the oxidizer (air).

This feature has at least two advantages. A first advantage is the fact that it allows using ordinary sensors, normally air calibrated, which do not require specific calibrations for the types of gas/gases with which the burner will operate. In addition, precisely because the sensor unit measures the differential pressure in air, the sensor measurement is independent of the type of gas that is being measured, making it possible to operate with different types/qualities of gas.

In an embodiment, the control unit is programmed to generate the drive signals based on (as a function of, responsive to) the first and/or the second differential pressure. In other words, the control unit is programmed to drive the fan and/or the gas regulating valve based on (as a function of, responsive to) the first and/or the second differential pressure.

In an embodiment, the device comprises a mixer, located along the intake duct at the mixing zone. The sensor unit is associated with the mixer. It should be noted that in some embodiments, the sensor unit is connected to (located on, attached to) the mixer. In other embodiments, on the other hand, the sensor unit (or a generic pair of sensors) may be spaced from the mixer while still tapping the pressure to be measured in the first, second and third detecting sections.

The mixer is interposed between two sections of the intake duct. The mixer is connected to the injection duct to receive the gas therefrom.

The mixer comprises a first through cavity, which opens onto the first detecting section. The mixer comprises a second through cavity, which opens onto the second detecting section. The mixer comprises a third through cavity, which opens onto the third detecting section.

The sensor unit also comprises a first pressure connection and a second pressure connection. Preferably, the sensor unit comprises a third pressure connection.

The first and the second pressure connection are inside the first and the second through cavity, respectively. Further, when present, the third pressure connection is inside the third through cavity.

That way, the three pressure connections detect the pressure in the first section, the pressure in the second section and the pressure in the third section. With this information, the sensor unit, or the control unit connected to it, can calculate the values of the first and/or the second differential pressure. In effect, the first differential pressure is measured between the first and the second pressure connection, and the second differential pressure is measured between the first and the third pressure connection.

In an embodiment, the mixer and/or the sensor unit are located downstream of the fan along the intake duct (that is, on a delivery side of the fan) in the direction of mixture inflow into the combustion head. In an alternative embodiment, the mixer and/or the sensor unit are located upstream of the fan along the intake duct (that is, on an intake side of the fan) in the direction of mixture inflow into the combustion head.

In an embodiment, the sensor unit comprises a first sensor, including a respective pressure connection for the first detecting section and a respective pressure connection for the second detecting section. The sensor unit also comprises a second sensor, including a respective pressure connection for the first detecting section and a respective pressure connection for the third detecting section.

In another embodiment, the sensor unit comprises a single sensor. The single sensor includes a pressure connection for the first detecting section, a pressure connection for the second detecting section and a pressure connection for the third detecting section.

Thanks to the self-checking procedures described in this disclosure, the embodiment with the single sensor may comprise a single processor (located in the electronic section of the sensor unit), which receives information relating to pressure (or drop/difference in pressure) from the pressure connection of the first detecting section, from the pressure connection of the second detecting section and from the pressure connection of the third detecting section. The control unit might exchange (self-)checking data with the processor (of the sensor unit) in order to test the processor itself for correct operation. By comparing the two measurements, the processor (of the sensor unit) may itself self-check the correctness of the measurement in the manner described below, alternatively or in addition to the checks performed by the control unit.

According to an aspect, in the device of this disclosure, the control unit is programmed to adjust the fan and/or the gas regulating valve in order to vary the flow rate by a predetermined quantity.

Further, the control unit (together with the sensor unit) is configured to detect a first variation, representing a variation in the first differential pressure due to the predetermined flow rate variation.

Preferably, the control unit (together with the sensor unit) is also configured to detect a second variation, representing a variation in the second differential pressure due to the predetermined flow rate variation.

The control unit (the sensor unit) is configured to perform a diagnostic test on the sensor unit, based on the first and/or the second variation.

In an example embodiment, during the diagnostic test on the sensors, the control unit is programmed to compare the first variation with a first predetermined variation. Preferably, the control unit is programmed to compare the second variation with a second predetermined variation. It should be noted that the control unit has access to a database (a data storage unit, a memory unit) in which the first and the second predetermined variations are stored in association with the corresponding predetermined flow rate variation.

This allows providing a reliability index for the sensor measurements which may be subject to a certain amount of drift over time, which could eventually cause them to give very unreliable readings. By comparing the measurements with known, ideal measurements, the control unit may "see" whether a sensor is faulty or whether its accuracy has drifted to a level that is unacceptable in terms of safety standards.

In an example embodiment, during the diagnostic test on the sensors, the control unit is programmed to determine a first trend, representing the fact that the first variation is positive or negative.

In the previous case and hereinafter, the term "positive" is used to denote a trend such that the differential pressure increases in response to the predetermined flow rate variation, and the term "negative" is used to denote a trend such that the differential pressure decreases in response to the predetermined flow rate variation.

Preferably, the control unit is also programmed to determine a second trend, representing the fact that the second variation is positive or negative.

The control unit is programmed to compare the first trend with the second trend, to verify that the first and the second variation are both positive or both negative.

That way, it is possible to see whether the sensors are working properly or whether at least one of them is not working properly. In effect, owing to the position of the second and third sections, the first differential pressure and the second differential pressure are always negative (that is, the pressure in the second and in the third section is always less than that in the first section) and, furthermore, always vary in the same way, in the sense that a flow rate variation ideally determines the same variation in the differential pressure.

Preferably, the control unit is programmed to generate a notification of possible fault if the first and the second variation have opposite signs. For example, the control unit is configured to stop the burner until human maintenance action is taken.

In an embodiment, the device comprises a first control sensor. The first control sensor is configured to be mounted inside the combustion cell to detect a control signal. The control signal preferably represents the presence of a flame deriving from combustion inside a combustion cell of the burner. Alternatively or in addition, the control signal might also represent a temperature inside the combustion cell or other combustion process sensor, for example, a lambda probe or a quantity that determines the intensity of the flame signal itself. The control unit is configured to generate the drive signals based on the control signal.

The device comprises a first flame sensor (which, for example, defines the control sensor) configured to detect a first flame signal, representing the presence of a flame deriving from the combustion of a first type of fuel inside a combustion cell of the burner.

Advantageously, the device comprises a second flame sensor, configured to detect a second flame signal, representing the presence of a flame deriving from the combustion of a second type of fuel inside a combustion cell of the burner.

The processor is programmed to receive fuel data, representing the fact that the gas fuel belongs to the first type or the second type.

The control signal is defined by the signal of the first flame sensor and/or of the second flame sensor, depending on the fuel data.

Thus, the processor processes the first or the second flame signal based on the fuel data, in order to generate the drive signals.

According to an aspect of it, this disclosure provides a method for controlling the fuel-oxidizer mixture in a premix gas burner.

The method comprises a step of generating an air flow, by means of a fan, in an intake duct including an inlet for receiving the oxidizer, a mixing zone, and an outlet for delivering the mixture to the burner.

The method comprises a step of feeding fuel into the mixing zone through an injection duct.

The method comprises a step of mixing the oxidizer and the fuel in the mixing zone. The method comprises a step of regulating the fuel flow rate through a gas regulating valve.

The method comprises a step of generating drive signals via a control unit. The method comprises a step of sending the drive signals to the gas flow regulating valve and/or to the fan.

The method comprises a step of detecting a first differential pressure, between a first detecting section, located in the intake duct upstream of the mixing zone in the direction of inflow and a second detecting section, located in the intake duct downstream of the mixing zone in the direction of inflow.

Advantageously, the method also comprises a step of detecting a second differential pressure, between the first detecting section and a third detecting section located in the injection duct between the gas regulating valve and the mixing zone.

The method comprises a step of performing a diagnostic test.

The step of performing a diagnostic test comprises a step of commanding a predetermined flow rate variation by regulating the fan or the gas regulating valve.

The step of performing a diagnostic test comprises a step of detecting a first variation, representing a variation in the first differential pressure due to the predetermined flow rate variation.

Preferably, the step of performing a diagnostic test comprises a step of detecting a second variation, representing a variation in the second differential pressure due to the predetermined flow rate variation.

The step of performing a diagnostic test comprises a step of performing a diagnostic test on the sensor unit, based on the first and/or the second variation.

In an embodiment of the method, the step of performing a diagnostic test comprises a step of comparing the first variation with a first predetermined variation.

Moreover, in a particularly advantageous embodiment, the step of performing a diagnostic test comprises a step of comparing the second variation with a second predetermined variation. The first and the second predetermined variation are associated with the predetermined flow rate variation.

In an embodiment of the method, the step of performing a diagnostic test comprises a step of determining a first trend, representing the fact that the first variation is positive or negative.

It is also preferable to perform a step of determining a second trend, representing the fact that the second variation is positive or negative.

Next, the method comprises comparing the first trend with the second trend, to verify that the first and the second variation are both positive or both negative.

Lastly, it is advantageous to provide a step of generating a notification of possible fault (that is, a step of stopping the burner) if the first and the second variation have opposite signs.

The method comprises a step of providing a mixer, mounted along the intake duct at the mixing zone. The method comprises a step of connecting the sensor unit to the mixer. The step of connecting comprises a step of connecting the sensor unit on an outside surface, facing outwards from the intake duct, to allow the sensor unit to be mounted on the mixer quickly and easily. The object constituted by the mixing unit and the sensor/sensors may, alternatively, form an integral part of (be constituted as one with or be locked to) the fan.

According to other advantageous aspects of it, the method comprises a step of providing a first pressure connection, a second pressure connection and a third pressure connection. The method also comprises a step of inserting the first pressure connection, the second pressure connection and the third pressure connection into a first, a second and a third through cavity of the mixer, respectively.

The first, the second and the third through cavity are open onto the first detecting section, the second detecting section and the third detecting section, respectively.

The first differential pressure is measured between the first and the second pressure connection. The second differential pressure is measured between the first and the third pressure connection.

It should be noted that the term "burner" is used to denote the set of features described herein, including, amongst others, the combustion head and the control device according to one or more of the features described herein with reference to the control device. According to an aspect of it, therefore, this disclosure provides a premix gas burner including a combustion head into which the premixed gas is delivered for combustion, and a control device according to one or more of the features described herein with reference to the control device.

BRIEF DESCRIPTION OF THE DRAWINGS

These and other features will become more apparent from the following description of a preferred embodiment, illustrated by way of non-limiting example in the accompanying drawings, in which.

DETAILED DESCRIPTION

Figure 1A:
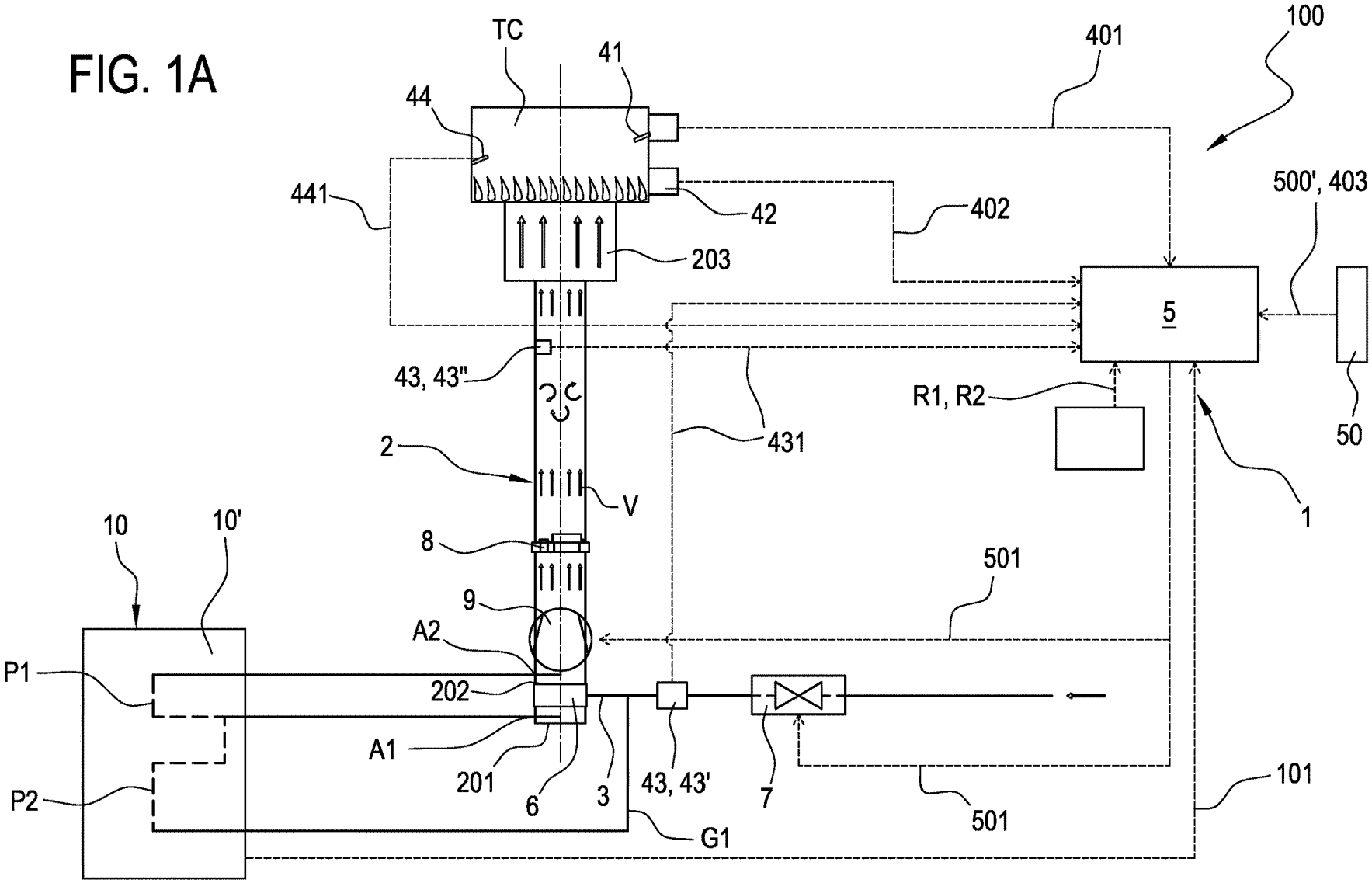
FIGS. 1A and 1B schematically illustrate a first and a second embodiment of a control device of this disclosure.
Figure 1B:
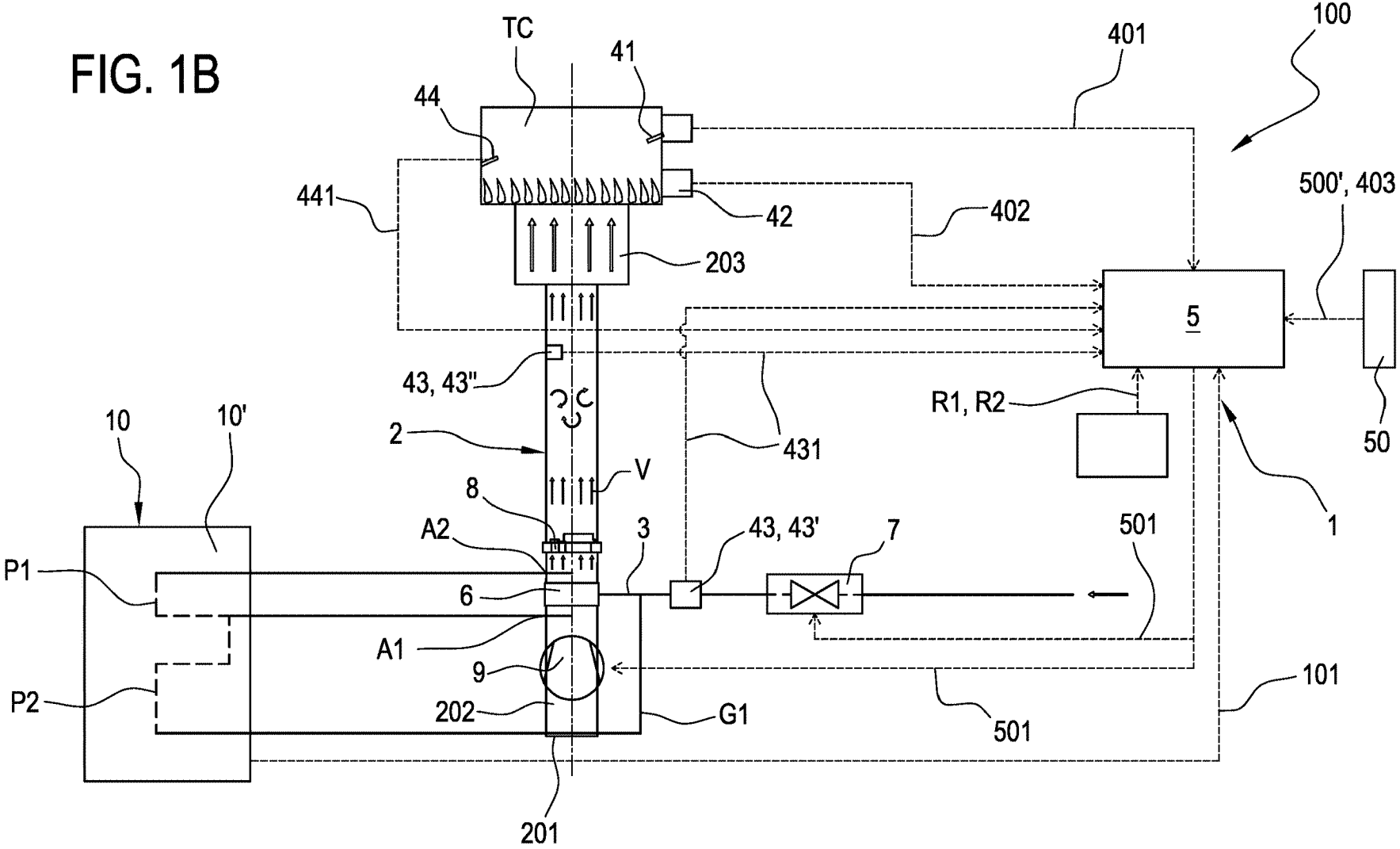
Figure 2B:
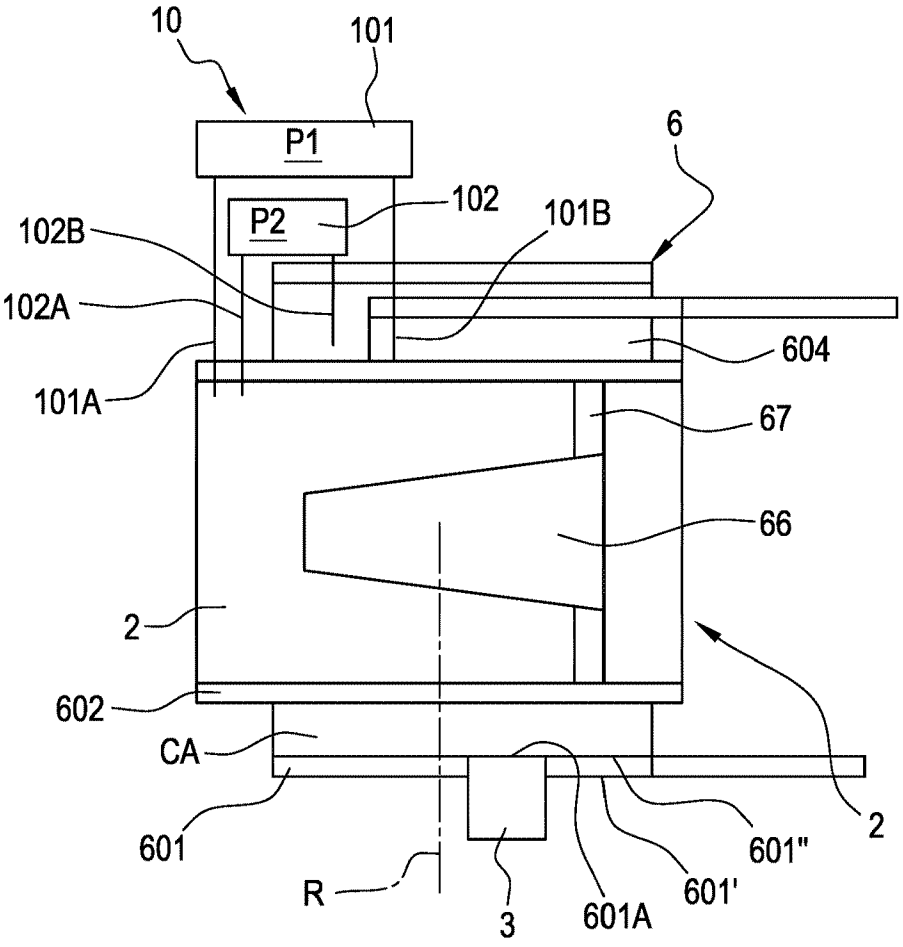
FIGS. 2A and 2B show, respectively, a perspective view and a schematic cross sectional view of a mixer of the device of FIG. 1.
Figure 2A:
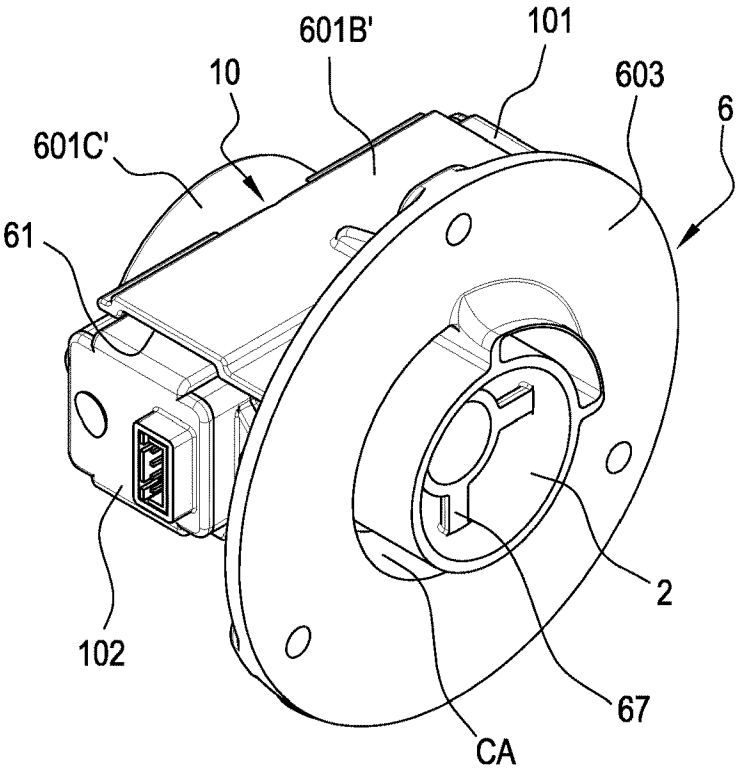
Figure 3B:
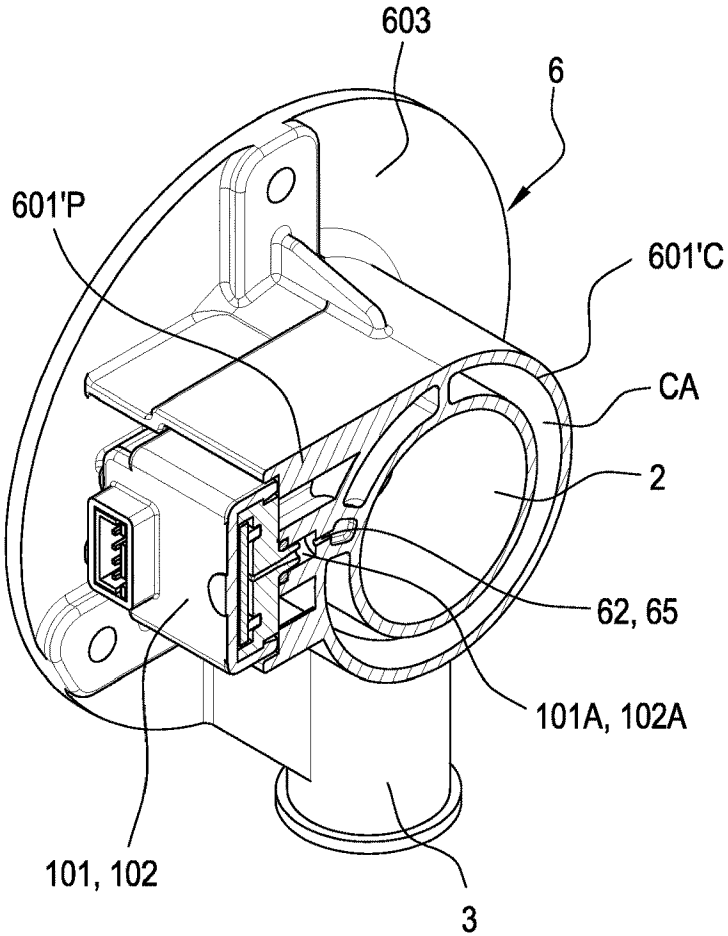
FIGS. 3A and 3B show, respectively, a first perspective section and a second perspective section of an embodiment of a mixer of this disclosure.
Figure 3A:
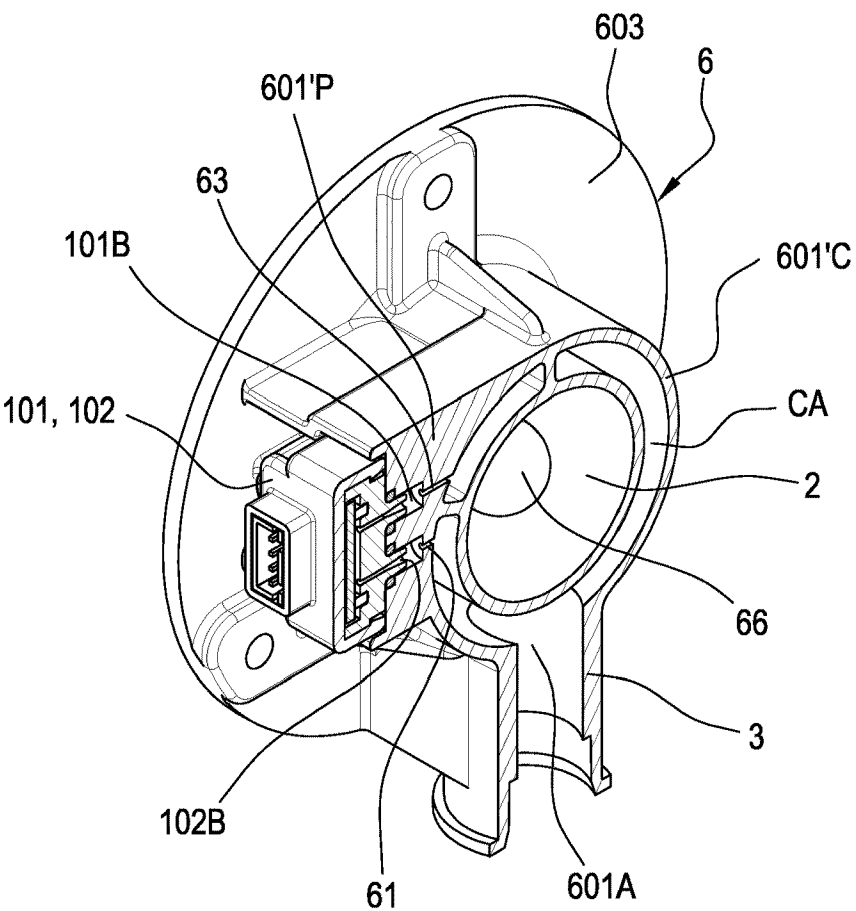
Figure 4B:
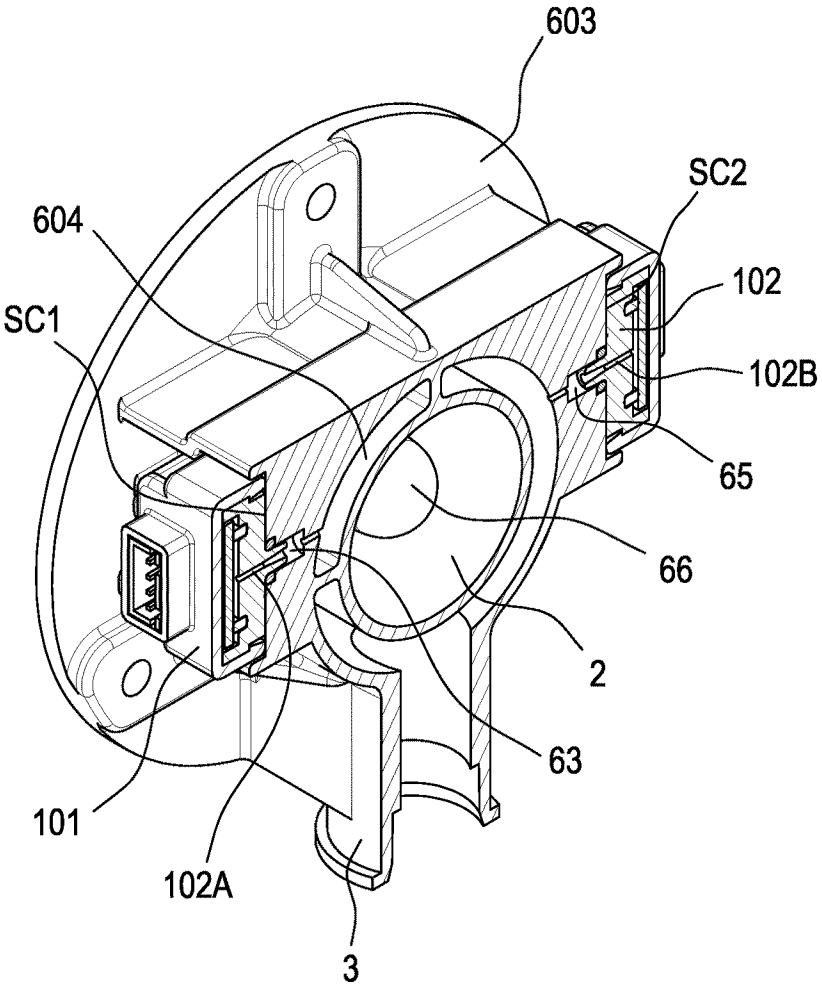
FIGS. 4A and 4B show, respectively, a first perspective section and a second perspective section of the mixer of FIG. 2A.
Figure 4A:
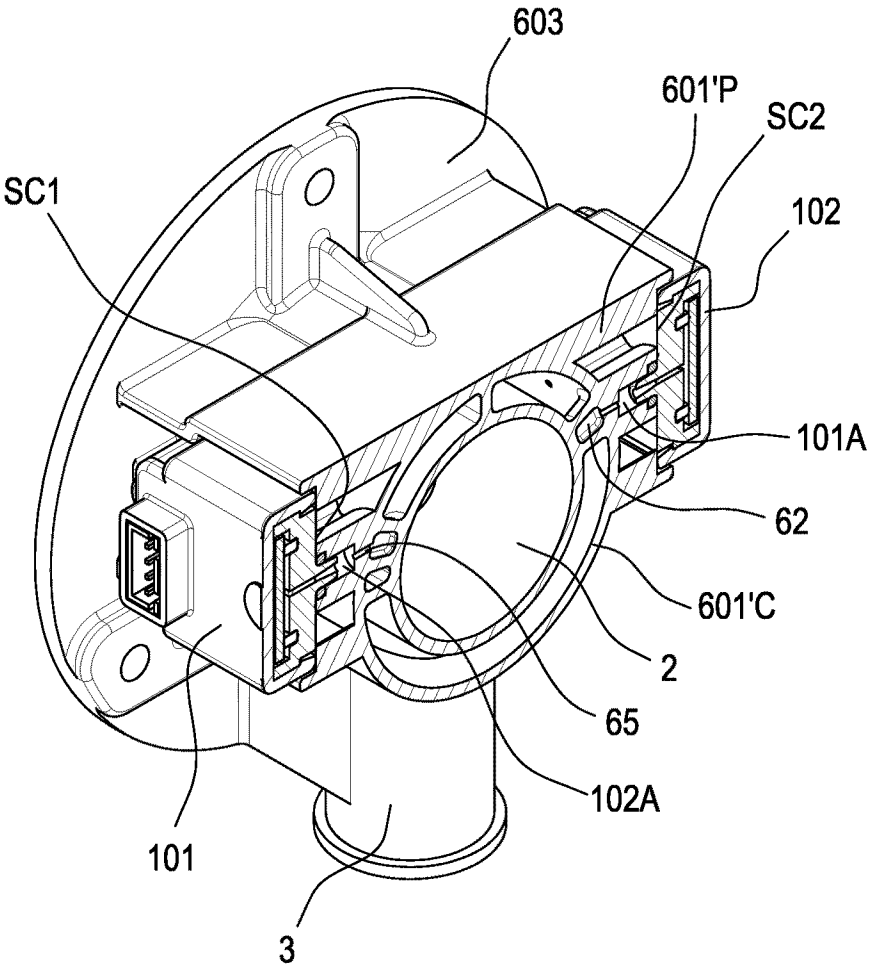
Figure 5:
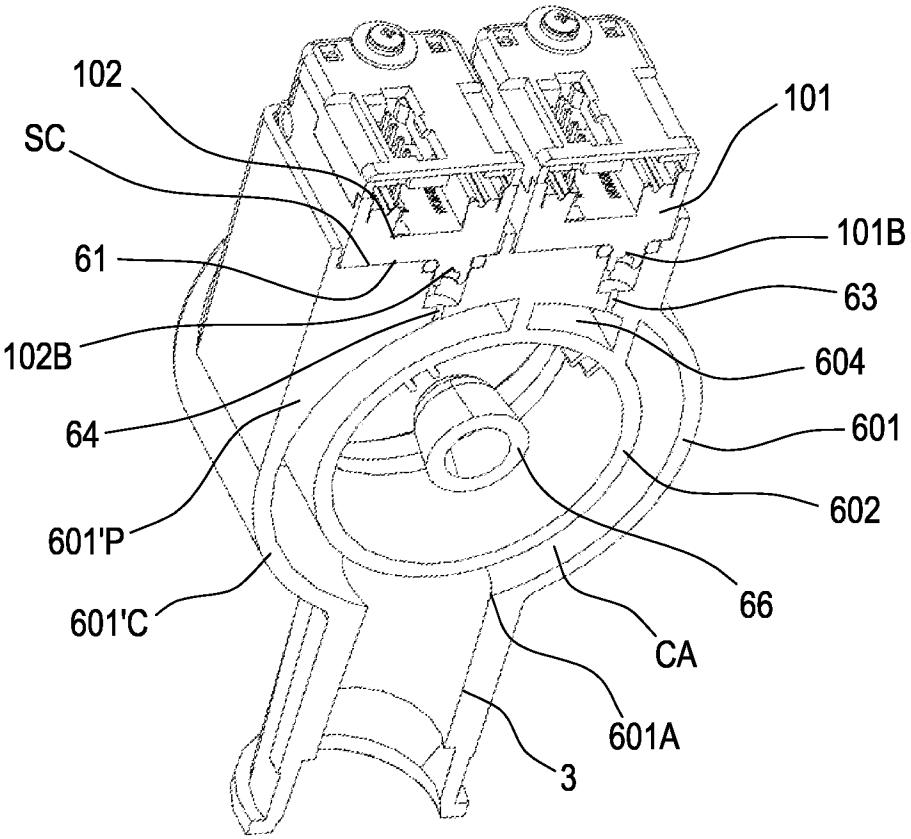
FIG. 5 shows a perspective section of an embodiment of a mixer according to this disclosure.

With reference to the accompanying drawings, the numeral 1 denotes a device for controlling the fuel-oxidizer mixture in premix gas burners 100.

The device comprises an intake duct 2 which defines a section S through which a fluid is admitted into the duct. The intake duct 2 may be circular or rectangular in section. The intake duct 2 extends from (includes) an inlet 201, configured to receive the oxidizer, to (and) a delivery outlet 203, configured to supply the mixture to the burner 100. The intake duct 2 comprises a mixing zone 202 for receiving the fuel and allowing it to be mixed with the oxidizer.

The device 1 comprises an injection duct 3. The injection duct 3 is connected, at a first end of it, to the intake duct 2 in the mixing zone 202, to supply the fuel. The injection duct 3 is connected, at a second end of it, to a gas supply such as, for example, a gas cylinder or the national gas grid.

The device 1 comprises a gas regulating valve 7. The gas regulating valve 7 is located along the injection duct 3. In an embodiment, the gas regulating valve 7 is electronically controlled. The gas regulating valve 7 comprises a solenoid valve. The gas regulating valve 7 is configured to vary a section of the injection duct 3 as a function of drive signals 501 sent by a control unit 5.

The device 1 comprises a fan 9. The fan 9 rotates at a variable rotation speed v. The fan 9 is located in the intake duct 2 to generate therein a flow of oxidizer in a direction of inflow V oriented from the inlet 201 to the delivery outlet 203.

In an embodiment, the device 1 comprises a regulator 8. In an embodiment, the regulator 8 is configured to vary the flow rate of oxidizer flowing through the intake duct 2. In an embodiment, the regulator 8 is configured to prevent fluid from flowing in a return direction, opposite of the direction of inflow V.

In an embodiment, the regulator comprises at least one partializing valve (and/or a non-return valve) 8. By partializing valve is meant a valve capable of varying its operating configuration as a function of the rotation speed of the fan 9, that is, of the flow rate of mixture. By non-return valve is meant a valve configured to allow a fluid to flow in one direction only and to prevent the fluid from flowing back in the opposite direction in the event of counterpressure.

In an embodiment, the regulator comprises at least two partializing valves. In an embodiment, one partializing valve is configured to vary its position in a working range different from that of the other partializing valve.

The device 1 comprises a control unit 5. The control unit 5 is configured to control the speed of rotation v of the fan 9 between a first rotation speed, corresponding to a minimum flow rate of oxidizer, and a second rotation speed, corresponding to a maximum flow rate of oxidizer.

The control unit 5 is configured to generate drive signals 501 used to control the fan 9 and the gas regulating valve 7. The drive signals 501 represent a rotation speed of the fan 9.

In an embodiment, the control unit 5 is configured to control opening of the gas regulating valve 7. Thus, in an example embodiment, the drive signals 501 represent opening the gas regulating valve 7, hence a flow of gas delivered to the mixing zone.

In an embodiment, the device 1 comprises a user interface 50, configured to allow a user to enter configuration data.

The configuration data comprise data that represent working parameters of the device 1 such as, for example, temperature of the fluid heated by the burner, pressure of the fluid in the burner, flow rate.

In an embodiment, the control unit 5 is configured to receive configuration signals 500', representing the configuration data, and to generate the drive signal 501 as a function of the configuration signals 500'.

The device 1 comprises a first monitoring device 41 (that is, a first flame sensor 41). The first flame sensor 41 is configured to generate a first control signal 401 (or first flame signal 401). In an embodiment, the first flame signal 401 represents a state of combustion in the burner 100 due to the combustion of a first type of fuel. Preferably, the first type of fuel is hydrogen. The first flame sensor 41 is located in a combustion head TC of the burner 100.

The first flame signal 401 is a signal representing a physical parameter which the respective sensor is configured to detect in order to assess combustion. For example, in the case of hydrogen, the first flame signal 401 is preferably a signal representing the detection of ultraviolet—UV—rays.

In a particularly advantageous embodiment, the device 1 comprises a second monitoring device 42 (that is, a second flame sensor 42). The second flame sensor 42 is configured to generate a second control signal 402 (or second flame signal 402). In an embodiment, the second flame signal 402 represents a state of combustion in the burner 100 due to the combustion of a second type of fuel. Preferably, the second type of fuel comprises methane, LPG or, more in general, a mixture of hydrocarbons. The second flame sensor 42 is located in a combustion head TC of the burner 100.

The second flame signal 402 is a signal representing a physical parameter which the respective sensor is configured to detect in order to assess combustion of the second type of fuel. For example, in the case of the hydrocarbons, the second flame signal 402 is preferably a signal representing the entity of a current due to the ionization, or alternatively to the impedance measured by an electrode immersed in the flame and supplied with voltage.

In an embodiment, the processor receives fuel data 403, representing the fact that the fuel used belongs to the first type, to the second type or is a mixture of the first and the second type.

In an example, the fuel data 403 are sent via the user interface 50, for example, as part of the configuration data entered manually by the user.

In a preferred embodiment, the first and the second flame signal 401, 402 are sent to (are received in) the processor. In other embodiments, the processor receives only one between the first and the second flame signal 401, 402, based on the fuel that is being used, that is to say, based on the fuel data 403.

In an embodiment, the device comprises a memory unit containing first regulation data R1 representing regulation data of the burner in the presence of fuel of the first type, and second regulation data R2 representing regulation data of the burner in the presence of fuel of the second type. More generally speaking, the memory unit includes a plurality of regulation data groups R, each of which is associated with a respective type (composition) of the fuel being used.

The processor is programmed to select the first or the second regulation data R1, R2 based on the fuel data 403.

The processor is programmed to generate the drive signals 501 based on the regulation data selected and based on the first and/or the second flame signal 401, 402.

In the embodiment in which the processor receives both the first and the second flame signal 401, 402, the processor is programmed to automatically receive the fuel data 403.

More specifically, in an embodiment, the intensity of the first flame signal (that is, the intensity of the UV signal) is associated with the quantity of hydrogen used in the combustion head TC. Further, the intensity of the second flame signal (that is, the intensity of the continuous ionization signal) is associated with the quantity of fossil fuels used in the combustion head TC.

This allows distinguishing the type of fuel used so that the burner can be monitored, run and maintained more safely and efficiently.

The processor, therefore, is programmed to derive a presence of the first and/or the second type of fuel (to define the fuel data 403) based on the intensity of the first and/or the second flame signal 401, 402. Preferably, the processor is programmed to derive a quantity of the first type of fuel and/or a quantity of the second type of fuel (to define the fuel data 403) based on the intensity of the first and/or the second flame signal 401, 402.

Based on the first and/or the second flame signal 401, 402, the processor may also determine a flow rate (a quantity) of fuel of the first type and/or of the second type in the combustion head.

In an embodiment, the monitoring device 4 comprises a flow or flow rate sensor 43 (or a sensor for measuring differential pressure between one side of a diaphragm or Venturi and the other). The flow sensor 43 is located on the intake duct 2 or on the injection duct 3 and is configured to detect a flow rate signal 431 representing a flow of fuel-oxidizer mixture delivered to the combustion head TC or a flow of fuel injected into the mixing zone. In an embodiment, there may be more than one flow sensor 43 to form a plurality of flow sensors 43. The flow sensors 43 may be pressure sensors or flow meters. In an embodiment, one flow sensor 43' is located in the gas injection duct 3 and another flow sensor 43" is located on the intake duct 2. In another embodiment, the flow sensor 43" is located on the intake duct upstream of the fan to provide data relating only to the flow rate of oxidizer.

The processor receives the flow rate signal 431 from the flow sensor 43.

In an embodiment, the flow sensor 43 is configurable on the basis of the fuel data 403. More specifically, the flow sensor 43 is configurable in such a way as to select a working curve that is more suitable for the fuel to be measured. In an embodiment, the sensor 43 located in the duct 2 may be a mixture composition sensor.

It is specified that the device of this disclosure can work independently of the presence of the flow sensors 43, 43' and 43", although the presence of these sensors can provide additional information for controlling the mixture or for cross checking the measurements.

The processor is programmed to compare the flow rate calculated with the flow sensor 43 with the flow rate calculated from the first and/or the second flame signal 401, 402. Based on this comparison, the processor calculates a real (measured) ratio between fuel and oxidizer. The processor compares the real (measured) ratio between fuel and oxidizer with an ideal ratio and accordingly generates an adjustment signal. The processor processes the adjustment signal and generates the drive signals 501 based also on the adjustment signal to set the real (measured) ratio between fuel and oxidizer as close as possible to the ideal ratio again.

It should be noted that in an embodiment, comparing the flow rate calculated with the flow sensor 43 with the fuel flow rate calculated from the first and/or the second flame signal 401, 402 makes it possible to derive information regarding the correct operation of the flow sensor 43, which is an essential condition for the safety measurements of the control device.

In an embodiment, the monitoring device 4 comprises a temperature sensor 44. The temperature sensor 44 is located in the combustion head TC. This temperature may, for example, be measured both in contact with, or in proximity to, the inside surface of the burner (not on the side where the flame is formed) or on the outside, in the combustion chamber, (on the side where the flame is) with a similar result.

The temperature sensor 44 is configured to detect a temperature signal 441, representing a temperature inside the combustion head TC. In an embodiment, there may be more than one temperature sensor 44 to form a plurality of temperature sensors 44.

It is noted that in calculating the real (measured) ratio between fuel and oxidizer, the processor receives the temperature signal and calculates the flow rate (the quantity) of the fuel of the first type and/or of the second type in the combustion head (that is, the real ratio between fuel and oxidizer) based on the temperature signal 441. The correlation between the fuel-oxidizer ratio and a process sensor (for example, the temperature sensor which detects the temperature signal 441) may be used as additional information to assess the correctness of the measurement given by the two sensors in the sensor unit. For example, if the temperature exceeds a first limit value (or a multiplicity of first limit values to build a curve), determined as a function of the power burn and corresponding to the ideal/chosen combustion for a given fuel (that is to say, in the presence of a combustion richer in fuel or in the absence of air), the control performs one or both of the following steps: compensating the reading of the air sensor, allowing the system to bring the quantity of air back to the correct value (increasing it) by controlling the fan, and/or compensating the reading of the fuel sensor to reduce the quantity of fuel by controlling the gas regulating valve. Similarly, it is possible for action to be taken if the temperature is below a second limit value (or a multiplicity of second limit values to build a curve), determined as a function of the power burn (that is to say, should combustion be poor in fuel or excessively rich in air). In this case, the control performs one or both of the following steps: compensating the reading of the air sensor, allowing the system to bring the quantity of air back to the correct value (decreasing it) by controlling the fan, and/or compensating the reading of the fuel sensor to increase the quantity of fuel by controlling the gas regulating valve.

In an embodiment, the device comprises a gas detection sensor, configured to measure the presence and/or the quantity of gas (preferably hydrogen) present inside the burner or in an outside space adjacent thereto.

In an embodiment, the processor has access to experimental data including, amongst other things, the ignition flow rate ranges for the first type of fuel and the second type of fuel (or a mixture thereof) and, for each ignition flow rate range, a respective expected flame signal (first flame signal 401 or second flame signal 402) and expected fuel flow rate.

In the step of igniting the burner, the method comprises supplying a progressive flow of fuel and interrupting the progression once the presence of the flame is detected (via the first flame signal 401 or the second flame signal 402).

Once ignition has been ascertained, the method comprises determining the type of gas being supplied, based on the level of the ionization signal and/or on the intensity of the UV radiation and/or on the fuel flow.

When the type of gas being supplied has been identified, the flow sensor 43 can be reconfigured in such a way as to select a working curve more suitable for the fluid to be measured (typically, in this specific case, for the oxidizer), hence keeping accuracy and resolution at the maximum allowed by the instrument, for improved adjustment quality and working/modulation range (defined as the ratio between the maximum and the minimum flow rate of the appliance). The configurability of the flow sensor 43 might not be automatic (via a self-learning boiler control) but determined by factory setting or set during installation. The configurability of the sensor may occur via data communications (for example, serial communication or remote communication).

Another drawback overcome by this invention regards cases where the gas supply pressure is low or where the supply is cut off altogether.

In the prior art, for example, in systems comprising only flow/pressure sensors or even mixture composition sensors, the management of low pressure or absence of gas is not safe. In effect, if the sensor does not detect the necessary quantity of fuel flow, the control systems might adjust the mixture by reducing the quantity of air but without direct feedback from combustion (in the case of a faulty sensor or a reading corrupted for some other reason), with possible dangerous consequences such as, for example, an increased risk of flashback or explosion.

Detecting the first flame signal 401 (that is, the intensity of UV radiation) allows confirming whether the presumed reduction in the availability of fuel is real and thus allows the quantity of air to be reduced and the appliance to operate correctly in complete safety, albeit with a reduced range.

Another function useful for safety is, at the ignition stage, checking whether the presence of the flame is detected via the first and/or the second flame signal 401, 402 even in the cases where the detected gas flow rate is not within a range considered minimal for ignition. In effect, in such a case, it is more than likely that the problem lies in a fault or malfunction of the flow sensor 43.

In an embodiment, the device 1 comprises a sensor unit 10. The device 1 preferably also comprises a mixer 6, which is associated with the intake duct 2 and with the injection duct 3. More specifically, the mixer 6 at least partly defines the mixing zone 202, allowing the fuel and the oxidizer to be mixed together. The sensor unit 10 is configured to detect a first differential pressure P1, between a first detecting section A1, located in the intake duct 2 upstream of the mixing zone 202 in the direction of inflow V and a second detecting section A2, located in the intake duct 2 downstream of the mixing zone 202 in the direction of inflow. The sensor unit 10 is configured to detect a second differential pressure P2, between the first detecting section A1 and a third detecting section G1, located in the injection duct 3 between the gas regulating valve 7 and the mixing zone 202.

In a purely exemplary embodiment, the sensor unit 10 comprises a first sensor 101. The sensor unit comprises a second sensor 102. The first sensor 101 is configured to detect the first differential pressure P1. The second sensor 102 is configured to detect the second differential pressure P2.

In an example embodiment, the mixer 6 comprises a receiving slot 61. The mixer 6 comprises a first cavity 62. The mixer 6 comprises a second cavity 63. The mixer 6 comprises a third cavity 64. In an example embodiment, the mixer 6 comprises a fourth cavity 65.

The mixer 6 comprises an outside wall 601. In an example embodiment, the outside wall 601 comprises an outside surface 601' having a profile which is defined by a first portion 601C', preferably cylindrical, and a second portion 601P', preferably prismatic, which extends from the first, cylindrical portion 601C'.

The second, prismatic portion 601P' defines the receiving slot 61.

The second, prismatic portion 601P' defines at least one connecting surface SC. In an embodiment, the second, prismatic portion 601P' defines a first connecting surface SC1 and a second connecting surface SC2. The first connecting surface SC1 is opposite the second connecting surface SC2. In effect, in such a case, the prismatic portion 601P' extends from the cylindrical portion 601C' in two opposite directions, which in practice define, with respect to the cylindrical portion 601C', two protrusions which define the first connecting surface SC1 and the second connecting surface SC2.

In an embodiment, the first and the second sensor 101, 102 are both connected to the at least one connecting surface SC. In other embodiments, on the other hand, comprising the first connecting surface SC1 and the second connecting surface SC2, the first sensor 101 is connected to the first connecting surface SC1 and the second sensor 102 is connected to the second connecting surface SC2.

The outside wall 601 comprises an inside surface 601", preferably cylindrical.

The mixer 6 comprises an inside wall 602. Preferably, the inside wall 602 is a cylindrical wall, coaxial with the outside wall 601.

The inside wall 602 and the outside wall 601 define an annular groove CA, comprising an annular space and interposed between the outside wall 601 and the inside wall 602.

The outside wall 601 comprises an injection orifice 601A. The injection orifice 601A is connected to the injection duct 3. Thus, the gas reaches the annular groove from the injection duct 3.

The mixer 6 comprises a connecting flange 603, connected to the portion of the intake duct 2 that is connected to the combustion cell TC. The connecting flange 603 is connected to the outside wall 601. The portion of the intake duct 2 that is connected to the combustion cell TC is connected to the connecting flange 603.

In an embodiment, the annular groove CA is open, at one end of it, onto the intake duct 2, downstream of the injection duct 3 in the direction of inflow V. In other embodiments, the inside wall 602 comprises a plurality of slits, through which the gas can mix with the air flowing in the inside wall 602.

In an embodiment, the mixer 6 comprises a connecting duct 604, which is open onto the intake duct 2, downstream of the injection duct 3 in the direction of inflow V (downstream of the mixer itself).

The connecting duct 604 is a blind duct. In other words, the connecting duct 604 has a first end which is open onto the intake duct 2 in a zone where the gas and the oxidizer are already mixed, and a second end which is closed. This allows the pressure in the connecting duct 604 to be equal to the pressure downstream of the mixing zone (downstream of the Venturi) in the direction of inflow V.

This structure allows the different detecting sections to be aligned along a radial direction R, perpendicular to the direction of flow of the fluid in the intake duct 2. In other words, in a particularly advantageous embodiment, the first detecting section A1, the second detecting section A2 and the third detecting section G1 are aligned along the radial direction R.

In effect, the space in the inside wall 602 defines the first detecting section A1, the annular groove CA defines the third detecting section G1 and the connecting duct 604 defines the second detecting section A2.

Preferably, the receiving slot 61 is aligned radially with the connecting duct 604. This allows the sensor to be vertically aligned with the connecting duct 604.

Thus, the first cavity 62 and/or the fourth cavity 65 are open onto the space in the inside wall 602. The second cavity 63, on the other hand, is open onto the connecting duct 604. Lastly, the third cavity 64 is open onto the annular groove CA. The first, second, third and fourth slots 62, 63, 64, 65 are open towards the outside of the mixer, at the receiving slot 61, so as to be able to receive the respective connectors provided in the first sensor 101 and/or in the second sensor 102.

The first sensor and/or the second sensor 101, 102 are housed in the receiving slot 61.

The first sensor 101 comprises a first, air pressure connection 101A and a second, mixture pressure connection 101B. The second sensor 102 comprises a second, air pressure connection 102A and a respective, gas pressure connection 102B.

It is noted that the first pressure connection of this disclosure corresponds to the first, air pressure connection 101A or to the second, air pressure connection 102A. In effect, as described above, in some cases, the air pressure connection may be shared between the two sensors 101, 102.

In an embodiment, the first, air pressure connection 101A is located inside the first cavity 62. In an embodiment, the second, air pressure connection 102A is located inside the fourth cavity 65. In an embodiment, the mixture pressure connection 101B is located inside the second cavity 63. In an embodiment, the gas pressure connection 102B is located inside the third cavity 64.

The first and the second sensor 101, 102 are connected to the control unit to send signals representing the first differential pressure P1 and the second differential pressure P2.

Preferably, the mixer 6 comprises a narrowing member 66. The mixer comprises a plurality of supporting elements 67. The narrowing member is located inside the intake duct 2 (that is, inside the space in the inside wall 602). More specifically, the narrowing member 66 is kept at a uniform distance from the inside wall 602 by the supporting elements 67. The narrowing member 66 comprises walls which are inclined with respect to the flow of oxidizer, so as to reduce the section area through which the fluid in the intake duct 2 flows in the direction of inflow V. The reduction in the section area causes the fluid to accelerate and produces a negative pressure, making gas suction (injection) and its subsequent mixing with the oxidizer more efficient.

According to an aspect of it, this disclosure provides a method for controlling a premix gas burner.

In particular, the method of this disclosure, comprises a step of runtime checking for the purpose of controlling the burner during its operation, and a step of performing a diagnostic test to check and control the sensors and other components of the control device.

Thus, during the step of runtime checking, the control unit receives control signals, such as, for example, but not only, the first flame signal 401, the second flame signal 402, the flow rate signal 431 and/or the temperature signal 441. Based on the control signals, the control unit generates the drive signals to operate the gas regulating valve 7 or vary the rotation speed of the fan 9. For this purpose, the control unit 5 has access to regulation data (for example, the first regulation data R1 or the second regulation data R2), defining working curves of the burner 100.

In the step of performing a diagnostic test on the sensors, on the other hand, the control unit 5 is intended to identify any malfunctions connected with the sensors, specifically malfunctions caused by sensor faults or drift giving rise to incorrect readings that could have a negative impact on sensor operation.

More specifically, the step of performing a diagnostic test can be carried out in two different configurations of the device (and of the burner): a configuration with the burner off and a configuration with the burner in operation.

In the configuration with the burner off, the control unit 5 is programmed to check whether the sensors of the control device 1 are reliable. For this purpose, the control unit 5 is reprogrammed to generate drive signals 501 representing a predetermined rotation speed of the fan 9 (or representing a predetermined pressure signal P1 or by feedback control of a predefined pressure/pressure difference signal P1) corresponding to a predetermined flow rate. The sensor unit 10 is also configured to detect the first differential pressure P1 and the second differential pressure P2 and to send these values to the control unit 5.

The control unit 5 compares the first differential pressure P1 and the second differential pressure P2 with reference data representing a correlation between a first predetermined differential pressure and a second predetermined differential pressure, associated with the specific flow rate set by the control unit 5.

The control unit 5 assesses the operation of the first and/or the second sensor 101, 102 based on the comparison of the first differential pressure P1 and the second differential pressure P2 with the reference data. If the first differential pressure P1 and the second differential pressure P2 do not match the reference correlation, the control unit 5 generates a notification of a possible fault of at least one between the first sensor 101 and the second sensor 102.

More specifically, the control unit 5 can detect the following cases:

(a) the correlation between the two measurements does not match the reference correlation;

(b) the correlation between the two measurements matches the reference correlation but the first and the second differential pressure P1, P2 are too low (in absolute terms) compared to the predetermined values, as might be the case, for example, if an occlusion downstream of the sensors causes a reduction in the flow rate.

In the case of point (a) above, the control unit is programmed to compare the first and the second differential pressure P1, P2 with the respective first and second predetermined differential pressure, respectively, so as to determine which of the two sensors is faulty or has drifted. After determining this, the control unit 5 performs one or both of the following steps:

stopping the burner 100 or placing it in secure mode;

determining the drift (deviation) between the first and the second differential pressure P1, P2 and the corresponding first or second predetermined differential pressure;

automatically correcting the measurement of the first sensor 101 or of the second sensor 102, based on the drift calculated.

In the case of point (b) above, the control unit is programmed to alert the user to the possible presence of a potential occlusion and/or of increased load losses along the intake duct 2 or on the exhaust of the appliance or downstream of the combustion chamber (for example, clogging of the exchanger).

It is noted that the configuration with the burner off also includes one of the following configurations:

the burner is switched off after a period of operation in order to perform a further check on the congruency of the measurements of the sensor unit;

the burner is switched off periodically in order to perform further checks on the congruency of the measurements of the sensor unit.

In these two cases, the control unit 5 performs the same checks as those set out above with reference to the configuration with the burner off.

In the configuration with the burner in operation, on the other hand, the control unit 5 is programmed to generate drive signals 501 that represent a predetermined variation in the rotation speed of the fan 9 or a predetermined movement of the gas regulating valve, corresponding to a variation in the flow rate. The sensor unit 10 is also configured to detect a variation in the first differential pressure P1 (first variation) and/or a variation in the second differential pressure P2 (second variation) and to send the first and the second variation to the control unit 5.

The control unit 5 compares the first variation and the second variation with the reference data representing a predetermined variation in the first differential pressure and a predetermined variation in the second differential pressure, due to the predetermined flow rate variation set by the control unit 5.

The control unit 5 assesses the operation of the first and/or the second sensor 101, 102 based on the comparison of the first variation and the second variation with the reference data. More specifically, the control unit 5 checks that:

(c) the first variation corresponds (within a certain tolerance range) to the predetermined variation in the first differential pressure;

(d) the second variation corresponds (within a certain tolerance range) to the predetermined variation in the second differential pressure;

(e) the first variation and the second variation are the same in sign, that is that both of the sensors detect, at the second section A2 and at the third section G1, the same pressure reduction or increase resulting from the variation in the flow rate.

If at least one of the points (c), (d) or (e) is not true, the control unit is programmed generate a notification of a fault of the first sensor 101 and/or of the second sensor 102 or, where possible, to compensate the reading of the sensor.

What is claimed is:

1. A device for controlling a fuel-oxidizer mixture for a premix gas burner, comprising:

an intake duct, which defines a section for the admission of an oxidizer fluid into the duct and includes an inlet for receiving the oxidizer, a mixing zone for receiving the fuel and allowing it to be mixed with the oxidizer, and an outlet for delivering the mixture to the burner;

an injection duct, which defines a section for the admission of the fuel and which is connected to the intake duct in the mixing zone to supply the fuel;

a gas fuel regulating valve, located along the injection duct;

a fan, located in the intake duct to generate therein a flow of the oxidizer fluid or of the fuel-oxidizer mixture in a direction of inflow oriented from the inlet to the delivery outlet;

a control unit, configured for generating drive signals, for regulating the gas regulating valve and the rotation speed of the intake fan;

a sensor unit, in communication with the control unit and configured for detecting a first differential pressure, between a first detecting section, located in the intake duct upstream of the mixing zone in the direction of inflow and a second detecting section, located in the intake duct downstream of the mixing zone in the direction of inflow, and a second differential pressure, between the first detecting section and a third detecting section, located in the injection duct between the gas regulating valve and the mixing zone; and a mixer, located along the intake duct, at the mixing zone, wherein the sensor unit is associated with the mixer, wherein the mixing zone is positioned upstream or downstream of the fan, the mixer comprising a first through cavity, open onto the first detecting section;

a second through cavity, open onto the second detecting section; and a third through cavity, open onto the third detecting section;

wherein the sensor unit comprises a first pressure connection, a second pressure connection and a third pressure connection, which are located inside the first, second and third through cavities, respectively.

2. The device according to claim 1, wherein the sensor unit comprises:

a first sensor, including a respective pressure connection for the first detecting section and a respective pressure connection for the second detecting section, and a second sensor, including a respective pressure connection for the first detecting section and a respective pressure connection for the third detecting section, or a single sensor, including a pressure connection for the first detecting section, a pressure connection for the second detecting section, and a pressure connection for the third detecting section.

3. The device according to claim 1, wherein the control unit is programmed for:

commanding a predetermined flow rate variation by regulating the fan or the gas regulating valve;

detecting a first variation, representing a variation in the first differential pressure due to the predetermined flow rate variation;

detecting a second variation, representing a variation in the second differential pressure due to the predetermined flow rate variation; and performing a diagnosis of the sensor unit based on the first and the second variation.

4. The device according to claim 3, wherein the control unit is programmed for:

comparing the first variation with a first predetermined variation; and comparing the second variation with a second predetermined variation, the first and the second predetermined variation being associated with the predetermined flow rate variation.

5. The device according to claim 3, wherein the control unit is programmed for:

determining a first trend, representing the fact that the first variation is positive or negative;

determining a second trend, representing the fact that the second variation is positive or negative;

comparing the first trend with the second trend, to check that the first and the second variation are both positive or both negative; and generating a notification of possible fault if the first and the second variation have opposite signs.

6. The device according to claim 1, wherein the sensor unit comprises a first pressure connection, a second pressure connection and a third pressure connection, in fluid communication with the first detecting section, the second detecting section and the third detecting section, respectively, and wherein the first differential pressure is measured across the first pressure connection and the second pressure connection, and the second differential pressure is measured across the first pressure connection and the third pressure connection.

7. A method for controlling a fuel-oxidizer mixture in a premix gas burner, comprising the following steps:

generating an air flow, by means of a fan, in an intake duct including an inlet for receiving the oxidizer, a mixing zone, and an outlet for delivering the mixture to the burner;

feeding fuel to the mixing zone through an injection duct;

mixing the oxidizer and the fuel in the mixing zone;

regulating the fuel flow rate through a gas regulating valve;

generating drive signals through a control unit and sending the drive signals to the gas regulating valve and to the fan;

detecting a first differential pressure, between a first detecting section, located in the intake duct upstream of the mixing zone in the direction of inflow and a second detecting section, located in the intake duct downstream of the mixing zone in the direction of inflow;

detecting a second differential pressure, between the first detecting section and a third detecting section, located in the injection duct between the gas regulating valve and the mixing zone;

providing a first pressure connection, a second pressure connection and a third pressure connection; and inserting the first pressure connection, the second pressure connection and the third pressure connection into a first, a second and a third through cavity of the mixer, respectively, wherein the first, the second and the third through cavity are open onto the first detecting section, the second detecting section and the third detecting section, respectively.

8. The method according to claim 7, comprising a step of diagnosing, including the following steps, performed by a processor of the control unit:

commanding a predetermined flow rate variation by regulating the fan or the gas regulating valve;

detecting a first variation, representing a variation in the first differential pressure due to the predetermined flow rate variation;

detecting a second variation, representing a variation in the second differential pressure due to the predetermined flow rate variation; and performing a diagnosis of the sensor unit based on the first and the second variation.

9. The method according to claim 8, wherein the step of diagnosing comprises the following steps:

comparing the first variation with a first predetermined variation; and comparing the second variation with a second predetermined variation, the first and the second predetermined variation being associated with the predetermined flow rate variation.

10. The method according to claim 7, wherein the step of diagnosing comprises a step of diagnosing with the burner off, comprising the following steps:

generating drive signals, representing a predetermined rotation speed of the fan, corresponding to a predetermined flow rate and/or pressure;

detecting, through the sensor unit, a value of the first differential pressure and of the second differential pressure, responsive to the predetermined flow rate;

sending the value of the first differential pressure and of the second differential pressure to the control unit;

comparing, in the control unit, the first differential pressure and the second differential pressure with respective reference data representing reference values of the first predetermined differential pressure and of the second predetermined differential pressure for the specific flow rate set by the control unit; and diagnosing the operation of the first and the second sensor based on the comparison of the first differential pressure and the second differential pressure, detected by the sensor unit, with the reference data.

11. The method according to claim 8, wherein the step of diagnosing comprises the following steps:

determining a first trend, representing the fact that the first variation is positive or negative;

determining a second trend, representing the fact that the second variation is positive or negative;

comparing the first trend with the second trend, to verify that the first and the second variation are both positive or both negative; and generating a notification of possible fault if the first and the second variation have opposite signs.

12. The method according to claim 7, wherein the method comprises a step of providing a mixer, mounted along the intake duct at the mixing zone and a step of connecting the sensor unit to the mixer.

13. The method according to claim 7, wherein the method comprises a step of providing a first pressure connection, a second pressure connection and a third pressure connection, in fluid communication with the first detecting section, the second detecting section and the third detecting section, respectively, and wherein the first differential pressure is measured across the first pressure connection and the second pressure connection, and the second differential pressure is measured across the first pressure connection and the third pressure connection.

14. The method according to claim 7, comprising the following steps:

receiving a flame signal representing the presence of a flame deriving from the combustion of a fuel belonging to a first predetermined type or a second predetermined type inside a combustion cell of the burner; and accessing fuel data, representing the fact that the gas fuel belongs to the first type or the second type;

wherein the processor has access to a memory unit containing first regulation data and second regulation data, different from the first regulation data and is programmed to generate the drive signals based on the first regulation data or, alternatively, on the second regulation data, depending on the fuel data.

15. The method according to claim 7, comprising an additional step of diagnosing, including the following steps, performed by a processor of the control unit:

detecting a temperature in the combustion cell;

comparing the detected temperature value with one or more limit values; and compensating a reading of the sensor unit based on the preceding step of comparing.

16. A device for controlling a fuel-oxidizer mixture for a premix gas burner, comprising:

an intake duct, which defines a section for the admission of an oxidizer fluid into the duct and includes an inlet for receiving the oxidizer, a mixing zone for receiving the fuel and allowing it to be mixed with the oxidizer, and an outlet for delivering the mixture to the burner;

an injection duct, which defines a section for the admission of the fuel and which is connected to the intake duct in the mixing zone to supply the fuel;

a gas fuel regulating valve, located along the injection duct;

a fan, located in the intake duct to generate therein a flow of the oxidizer fluid or of the fuel-oxidizer mixture in a direction of inflow oriented from the inlet to the delivery outlet;

a control unit, configured for generating drive signals, for regulating the gas regulating valve and the rotation speed of the intake fan;

a sensor unit, in communication with the control unit and configured for detecting a first differential pressure, between a first detecting section, located in the intake duct upstream of the mixing zone in the direction of inflow and a second detecting section, located in the intake duct downstream of the mixing zone in the direction of inflow, and a second differential pressure, between the first detecting section and a third detecting section, located in the injection duct between the gas regulating valve and the mixing zone, wherein the control unit is programmed for:

commanding a predetermined flow rate variation by regulating the fan or the gas regulating valve;

detecting a first variation, representing a variation in the first differential pressure due to the predetermined flow rate variation;

detecting a second variation, representing a variation in the second differential pressure due to the predetermined flow rate variation; and performing a diagnosis of the sensor unit based on the first and the second variation.

17. The device according to claim 16, wherein the control unit is programmed for determining a first trend, representing the fact that the first variation is positive or negative;

determining a second trend, representing the fact that the second variation is positive or negative;

comparing the first trend with the second trend, to check that the first and the second variation are both positive or both negative; and generating a notification of possible fault if the first and the second variation have opposite signs.

18. A method for controlling a fuel-oxidizer mixture in a premix gas burner, comprising the following steps:

generating an air flow, by means of a fan, in an intake duct including an inlet for receiving the oxidizer, a mixing zone, and an outlet for delivering the mixture to the burner;

feeding fuel to the mixing zone through an injection duct;

mixing the oxidizer and the fuel in the mixing zone;

regulating the fuel flow rate through a gas regulating valve;

generating drive signals through a control unit and sending the drive signals to the gas regulating valve and to the fan;

detecting a first differential pressure, between a first detecting section, located in the intake duct upstream of the mixing zone in the direction of inflow and a second detecting section, located in the intake duct downstream of the mixing zone in the direction of inflow; and detecting a second differential pressure, between the first detecting section and a third detecting section, located in the injection duct between the gas regulating valve and the mixing zone, wherein the method further comprises a step of diagnosing, including the following steps, performed by a processor of the control unit:

commanding a predetermined flow rate variation by regulating the fan or the gas regulating valve;

detecting a first variation, representing a variation in the first differential pressure due to the predetermined flow rate variation;

detecting a second variation, representing a variation in the second differential pressure due to the predetermined flow rate variation; and performing a diagnosis of a sensor unit based on the first and the second variation.

* * * * *